United States Patent [19]

Fricano

[11] 4,210,240

[45] Jul. 1, 1980

[54] TWO-WALLED CARTON

[75] Inventor: Phillip J. Fricano, Hamburg, N.Y.

[73] Assignee: The Quaker Oats Company, Chicago, Ill.

[21] Appl. No.: 11,715

[22] Filed: Feb. 12, 1979

[51] Int. Cl.[2] ..... B65D 5/42; B65D 25/00

[52] U.S. Cl. ..... 206/45.31; 229/37 R

[58] Field of Search ..... 206/45.31, 45.14; 229/16 R, 16 D, 37 R, 87 R, 87 F

[56] References Cited

U.S. PATENT DOCUMENTS

| | | | |
|---|---|---|---|
| 3,190,440 | 6/1965 | Palmer | 206/45.31 |
| 3,493,103 | 2/1970 | Cote | 229/39 B |
| 3,814,235 | 6/1974 | Glaze | 206/45.14 |
| 3,819,035 | 6/1974 | Jaeschke | 206/45.31 |
| 3,929,222 | 12/1975 | Smith | 206/806 |
| 4,083,447 | 4/1978 | Walters | 206/45.19 |

*Primary Examiner*—Herbert F. Ross

*Attorney, Agent, or Firm*—Cumpston & Shaw

[57] ABSTRACT

A two-walled carton for packaging an article. The carton has a front wall and an opposed rear wall joined together along their side edges to form a hollow enclosure of substantially elliptical cross section for receiving the article. The front wall of the carton has an end flap recessed from each end thereof. The end flaps close off the open ends of the carton when the end flaps are folded in a lateral direction substantially at right angles to the front wall. The end flaps extend toward and into engagement with the rear wall. The carton may be provided with an article supporting insert mounted within the container enclosure with the base panel of the insert in engagement with the rear wall. The base panel of the insert is further provided with hinged end panels at each end thereof. The end panels, when folded, extend in the opposite direction from the end flaps; that is, substantially at right angles to the base panel and toward the front wall of the container.

12 Claims, 7 Drawing Figures

TWO-WALLED CARTON

BACKGROUND OF THE INVENTION

1. Field of the Invention

This invention relates generally to packaging, and more specifically to a two-walled carton for packaging an article.

2. Description of the Prior Art

Two-walled cartons are generally well known in the art. In one such carton, the two walls comprise front and rear walls of substantially the same size joined together along their edges. Each wall is provided at each end thereof with an elliptically shaped, foldable end flap. The end flaps are folded toward one another in overlapping relation to form a closed carton of substantially elliptical cross section defining an enclosure for an article. One disadvantage of such a carton is that each closed end thereof is elliptically shaped when viewed from above, and lies in an arcuate surface when viewed from the side. Thus, each end presents a pair of spaced support points. Since two support points are insufficient to provide stable support, the carton, if vertically placed on either end and let go, will fall over. Accordingly, it is impossible to stand or place the carton on either end.

Another disadvantage of such carton is that the overlapped end flaps are easily detached if the carton is physically handled. Accordingly, such carton offers little resistance to unwarranted opening of the carton or tampering with the contents of the carton.

SUMMARY OF THE INVENTION

In accordance with a preferred embodiment of the invention, a two-walled carton is disclosed for packaging an article. The carton has a front wall and an opposed rear wall joined together along their side edges to form a hollow enclosure of substantially elliptical cross section for receiving the article. At least one end of one of the front and rear walls has an end flap hinged thereto along a straight hinge or fold line spaced from and parallel to a straight end of the wall. Each end flap has an arcuate end surface and fold lines extending outwardly from the center of the hinge line to the end surface. The fold lines facilitate folding each end flap so that the portion of the end flap located between the outermost fold lines extends substantially at right angles from one wall toward the other wall. In this folded position, the arcuate end surface of each end flap is in engagement with the other wall. Each end flap further has a projecting tongue centrally hinged to the arcuate end surface. In the assembled position of the carton, each tongue extends substantially at right angles to a complementary end flap. Each tongue further lies in parallel engagement with the rear wall, and in abutting engagement with a complementary arcuate shoulder.

In another aspect of the invention, the front wall of the carton is provided with a sight window through which the article can be viewed. Preferably, a transparent sheet is secured to the front wall overlying the sight window.

In another aspect of the invention, the carton is provided with an article supporting insert mounted within the carton enclosure. The article supporting insert has a base panel which is placed in engagement with the rear wall. The base panel is shorter than the rear wall of the container. The insert further has end panels hinged to the base panel along arcuate fold lines. Each end panel is adapted, when folded, to extend substantially at right angles from the base panel toward the front wall of the container. The shortest distance between the straight hinge lines of the front wall is substantially equal to the shortest distance between the arcuate fold lines of the end panel.

In still another aspect of the invention, each of the end panels of the insert has a curved end surface. The carton further has straight shoulders on the front wall opposite the straight hinge lines. The shoulders form stops for the curved end surfaces of the end panels in their folded positions. The stops prevent outward movement of the end panels to an unfolded position.

In a further aspect of the invention, the rear wall is provided with arcuate shoulders which in the assembled position of the carton are opposed to the straight shoulders of the front wall. The arcuate shoulders form stops for curved ends of the base panel defined by the arcuate fold lines. The arcuate shoulders further form stops for the arcuate end surfaces of the top and bottom end flaps.

One of the primary advantages of the improved two-walled carton of this invention is that at least one of the top and bottom end flaps is recessed so that the carton is provided with at least one flat top and/or bottom end enabling the carton to stand on the flat end without any outside support. The recessed end flap(s) further facilitates the placement of openings extending through the rear or front walls near the top end by which the carton may be hung on any suitable hanger such as a conventional toy rack.

Another advantage of the two-walled carton of this invention is its high resistance to unwarranted opening or tampering. This is achieved without the use of tapes or the reliance upon interaction between the article and the carton. P Still another advantage of the two-walled carton of this invention is that a locking tongue is provided to prevent the assembled carton from changing from a normal substantially elliptical configuration to a circular one when pressure is applied inwardly along the side edges of the carton.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
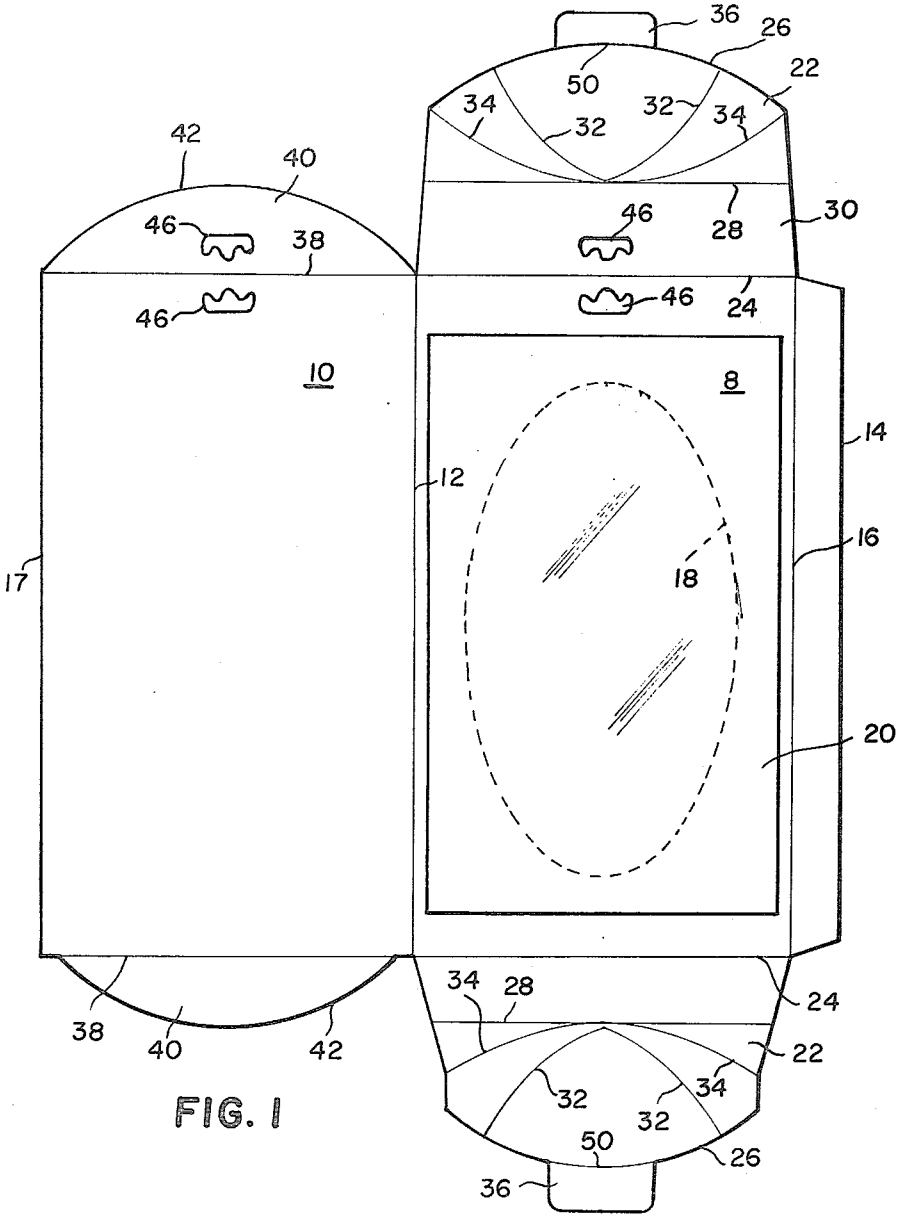
FIG. 1 is a plan view of a blank from which the two-walled carton is constructed.

With reference to FIG. 1, a preferred form of a blank is disclosed from which the two-walled carton of this invention is constructed. The blank comprises a front wall 8 and a rear wall 10 hinged together along a common side edge 12. The hinge is formed by a fold line of any suitable type such as a crease line, score line or perforated line. A side flap 14 is hinged to the opposite side edge 16 of the front wall for a purpose to be explained hereinafter.

Figure 2:
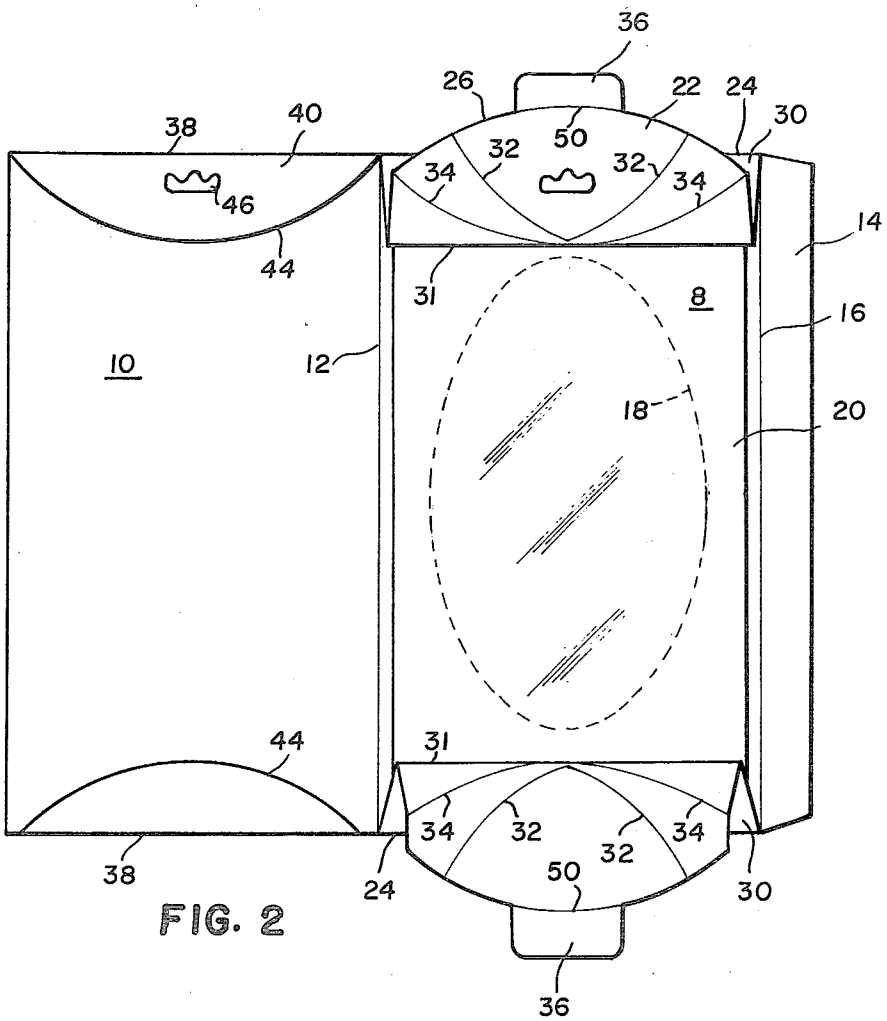
FIG. 2 is a view similar to FIG. 1 showing the top and bottom end flaps and end wings on the front and rear walls respectively folded over and glued into position.

The front wall 8 is rectangularly shaped and has an oval shaped sight window 18. A transparent sheet 20 overlies sight window 18 and is secured to front wall 8 by any suitable means. The front wall further has top and bottom end flaps 22 hinged to top and bottom ends 24 respectively. Each end flap 22 has an arcuate end surface 26, and a straight fold line 28 parallel to and spaced from its complementary straight end 24. A portion 30 of each end flap 22 extending between fold line 28 and straight end 24 is adapted to be folded along the straight end over front wall 8 and secured thereto by glue or the like as seen in FIG. 2. In this position, portion 30 forms a stop shoulder 31 opposite fold line 28. Each end flap further has arcuate fold or score lines 32, 34 extending outwardly from the center of fold line 28 to arcuate end surface 26 to facilitate folding the end flap when the carton is assembled. Each end flap 22 further has a projecting tongue 36 centrally hinged to arcuate end surface 26 for a purpose to be explained hereinafter.

The rear wall 10 has a free side edge 17, straight ends 38, and an end wing or flap 40 hinged to each straight end. Each end wing 40 has an arcuate free end 42. Each end wing is folded on its hinged connection over rear wall 10 and secured thereto by glue or the like to form an arcuate shoulder 44 as best seen in FIG. 2. The end flap portions 22 and end wings 40 further have openings 46 extending therethrough which mate with complementary openings 46 in the front and rear walls 8, 10 respectively when the end flap portions and end wings are folded over and glued.

Figure 7:
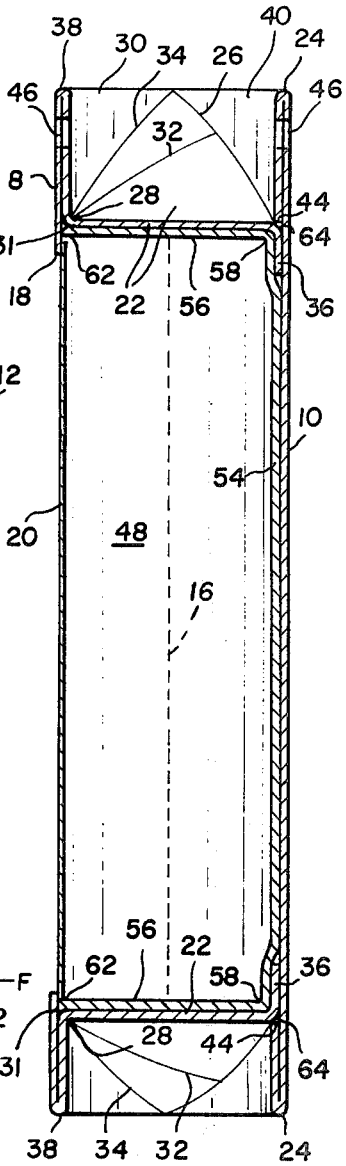
FIG. 7 is a section view taken substantially along line 7—7 of FIG. 4.
Figure 3:
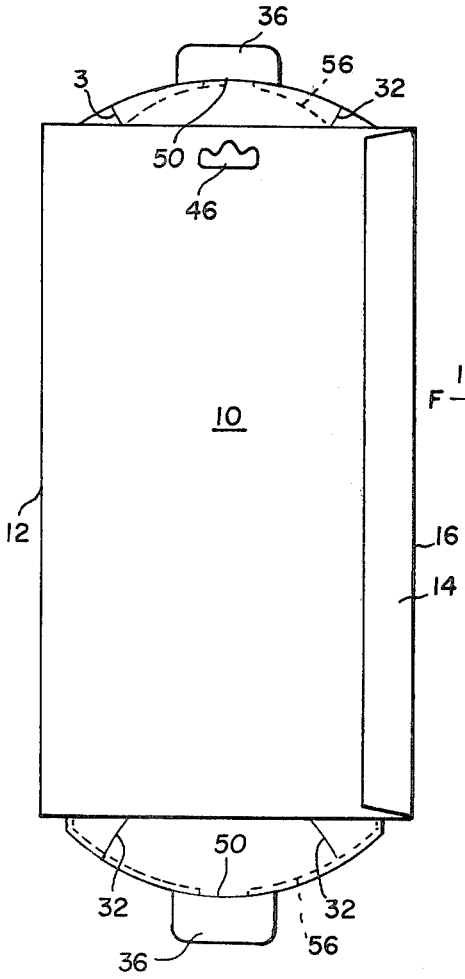
FIG. 3 is a rear elevational view of the two-walled carton showing the blank from which the article supporting insert is constructed in a position removed from the carton, and further showing in dotted lines the position of the insert when inserted into the carton prior to folding.
Figure 5:
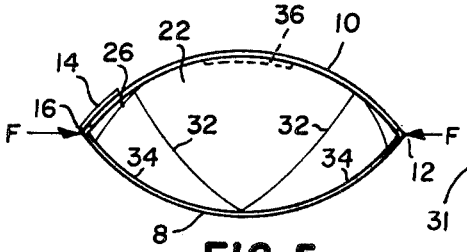
FIG. 5 is a top plan view of the carton of FIG. 4.
Figure 6:
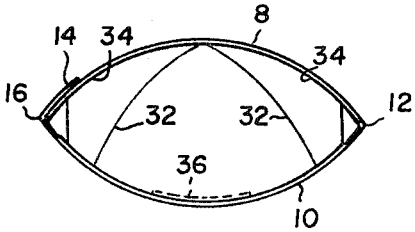
FIG. 6 is a bottom view of the carton of FIG. 4.

With reference to FIG. 3, the rear wall 10 of the blank shown in FIG. 2 is folded on the side edge fold line 12 over front wall 8 in overlapping relation. The side flap 14 of the blank is folded on side edge fold line 16 over rear wall 10 and secured to the rear wall along side edges 16, 17. To form a one piece, two-walled carton, the part of each end flap extending between outermost fold lines 34 is folded on fold lines 34 to extend substantially at right angles from the front wall toward the rear wall as best seen in FIG. 7. In this folded position, each arcuate end surface 26 engages rear wall 10 and abuts an arcuate shoulder 44 on the rear wall. Folding the end flaps 22 in this manner causes the front and rear walls to separate forming an article receiving enclosure 48 (FIG. 7) of elliptical shape in cross section as best seen in FIGS. 5 and 6. Normally, one end flap 22 is folded into position, an article such as a doll, not shown, inserted into enclosure 48, and the opposite end flap 22 then folded into its folded position to complete the carton.

Also, prior to folding each end flap 22, each projecting tongue 36 is folded over on a fold line 50 to depend substantially at right angles from the end flap. When the end flap is folded into its closed position, tongue 36 lies parallel to and in engagement with rear wall 8. In this position, as best seen in FIG. 7, each tongue 36 abuts an arcuate stop shoulder 44 on rear wall 8. Tongue 36 further coacts with the rear wall to prevent the carton from moving to a circular configuration when pressure is applied inwardly as indicated by force arrows in FIG. 5 to side edges 12, 16 of the assembled carton.

In another preferred embodiment of the invention, an article supporting insert 52 as illustrated in FIG. 3 is used in conjunction with the aforementioned one piece, two-walled carton. The article supporting insert 52 comprises a base panel 54 and end panels 56 foldable on arcuate fold lines 58. The insert 52 is mounted within the container enclosure 48 as best seen in FIG. 7 with its base panel 54 positioned in engagement with rear wall 10. An article is positioned on the insert prior to or after insertion of the insert. Each end panel 56 is folded on its arcuate fold line 58 to extend substantially at right angles from the base panel toward the inner surface of a complementary end flap 22. Each arcuate end surface 60 has a projection 62 which abuts a complementary stop shoulder 31 on front wall 8. Also, base panel 54 has arcuate ends 64 defined by and located opposite each arcuate fold line 58 after the end panel is folded. Each end 64 abuts a complementary arcuate stop shoulder 44 on rear wall 10. The net result of the stop shoulders 31, 44 is to substantially lock the article supporting insert within the two-walled carton.

Figure 4:
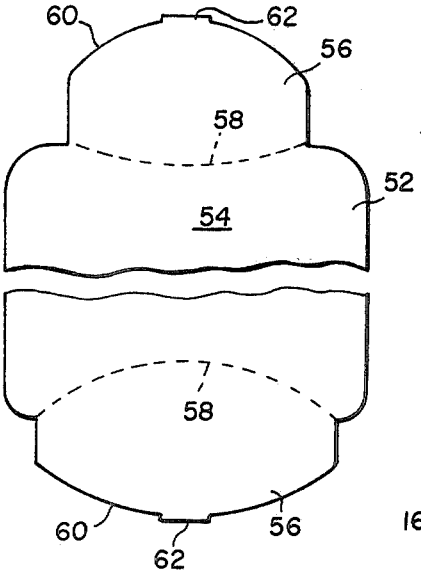
FIG. 4 is a front elevational view of the two-walled carton in its fully assembled position with a portion broken away and sectioned.
Figure 4:
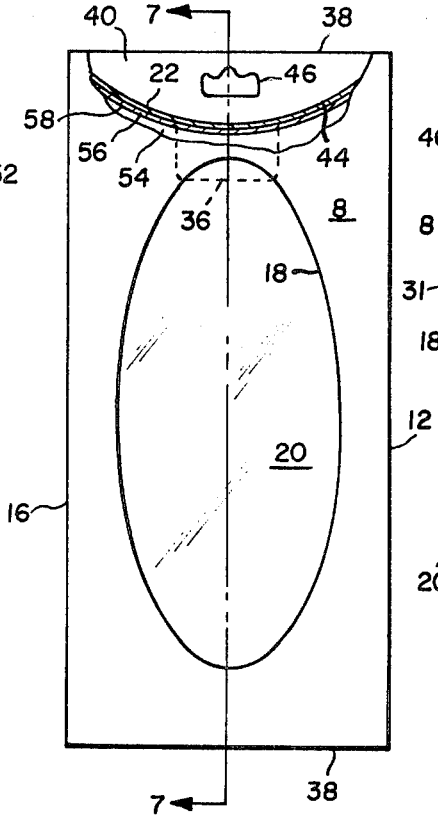

With reference to FIGS. 4–7, the embodiment of the invention illustrated in FIG. 3 is illustrated in its fully assembled position. After the article and article supporting insert 52 has been mounted within the carton 48, each end flap 22 is folded on its fold lines 32, 34 so that only the portion of the end flap extending between the outermost fold lines 34 extends substantially at right angles from front wall 8 toward rear wall 10. In this position, arcuate end surfaces 26 of end flaps 22 engage the rear wall and abut complementary arcuate shoulders 44. Since the shortest distance between straight shoulders 31 of the carton is substantially equal to the shortest distance between the arcuate end surfaces 64 of insert 56, the end flaps 22 and end panels 56 overlap in the assembled position in substantial engagement with one another as best seen in FIG. 4. The end flaps and end panels are substantially elliptical in shape in their folded position (that is, when folded over substantially at right angle to the base panel and front wall). The elliptical end flap portion 22 lies in an arcuate surface (FIG. 4), and extends between the outermost fold line 34 and end surface 26 (FIGS. 2 and 5). The elliptical end panel portion 56 also lies in an arcuate surface and extends between the fold line 58 and end surface 60 (FIG. 3).

Although the top and bottom end flaps 22 and top and bottom end panels 56 are not shown to be identical, they, of course, could be so constructed. To form a symmetrical carton, it is desireable that the elliptical portions formed by end surfaces 26 and fold lines 34 of the top and bottom end flaps 22 substantially coincide, if superimposed. Also, with regard to top and bottom end panels 56, it is preferable that the elliptical portions formed by each substantially coincide, if superimposed.

In addition, although end flaps 22 and end wings 40 are shown hinged to front wall 8 and rear wall 10 respectively, the positions of the end flaps and end wings could be reversed. Also, although the end flaps and end wings are shown at each end of the front and rear walls respectively, they could be located at only one end thereof and an entirely different end closure provided at the opposite end.

The invention has been described in detail with particular reference to preferred embodiments, but it will be understood that variations and modifications can be effected within the spirit and scope of the invention as described.

What is claimed is:

1. A hollow two-walled carton of substantially elliptical cross section defining an enclosure for an article comprising:

a front wall and an opposed rear wall; and an end flap having a first portion thereof hinged to one of the front and rear walls along an end flap hinge line spaced from and parallel to the end of the one wall, the first end flap portion having an arcuate end surface and end flap fold lines extending outwardly from the center of the end flap hinge line to spaced locations on said arcuate end surface to facilitate folding the first end flap portion so that a part thereof extending between the arcuate end surface and outermost end flap fold lines extends substantially at right angles from the one wall toward the other wall with the arcuate end surface in substantial engagement with the other wall.

2. The carton of claim 1, and further comprising a sight window in the front wall through which the article can be viewed, and a transparent sheet overlying the sight window and secured to the front wall.

3. The carton of claim 1 wherein a second portion of the end flap is hinged to the end of the one wall and folded over the one wall on its hinged connection and secured thereto.

4. The carton according to claim 1, and further comprising an article supporting insert mounted within the carton enclosure, the insert having a base panel shorter than the other wall of the carton and in engagement with the other wall, the insert further having at least one end panel hinged to the base panel along an arcuate insert fold line, the end panel adapted when folded to extend substantially at right angles from the base panel toward the one wall of the container.

5. The carton according to claim 4 wherein the end flap hinge line and a second end flap portion hinged thereto are provided adjacent each end of the one wall, and the base panel is provided adjacent each end with the arcuate insert fold line and the end panel hinged thereto, and the shortest distance between the end flap hinge lines is substantially equal to the shortest distance between the arcuate insert fold lines.

6. The carton according to claim 5 wherein each of the end panels has a curved end surface, the carton further comprising a first shoulder spaced from each end of the one wall and formed by a surface of the end flap along and opposite the end flap hinge line for forming a stop for one of the curved end surfaces of the end panels.

7. The carton according to claim 6 wherein each curved end surface has a projection engageable with the first shoulder, and each flap has an arcuate end surface, the carton further comprising arcuate shoulders on the other wall facing the first shoulders on the one wall for forming stops for (1) the ends of the base panel defined by the arcuate fold lines when the end panels are folded, and for (2) the arcuate end surfaces of the end flaps.

8. The carton according to claim 7 wherein each end flap has a projecting tongue centrally hinged to the arcuate end surface and extending, when folded, substantially at right angles to the end flap, the tongue further extending over a portion of the end of a complementary base panel and lying parallel to and in engagement with the other wall.

9. A carton composed from a blank of sheet material such as paperboard for packaging an article, the blank comprising:

a front rectangular wall;

a rear rectangular wall of substantially the same size as the front wall, the rear and front walls having end edges, and further being hinged together along adjacent side edges;

a side flap hinged to the opposite side edge of one of the front and rear walls for overlapping the opposite side edge of the other wall when the front and rear walls are folded in overlapping face-to-face relation, and for securing the opposite side edges together when the side flap is glued to the other wall to form a two-walled enclosure;

an end wing hinged to at least one end edge of one of the front and rear walls and having a first arcuate end surface, the end wing adapted to be folded over the one wall on its hinged connection and secured thereto by glue or the like to form an arcuate shoulder adjacent the end edge of the one wall; and an end flap hinged to at least one end edge of the other of the front and rear walls and having a second arcuate end surface, the end flap having an end flap hinge line parallel to and spaced from its hinge connection with the adjacent end edge and having the part of the end flap extending between the adjacent end edge and end flap hinge line adapted to be folded over the adjacent end edge of the other wall and secured thereto by glue or the like, the end flap further having inner and outer arcuate fold lines extending outwardly from the center of the end flap hinge line to spaced locations on the second arcuate end surface to facilitate folding the end flap so that the part of the end flap extending between the outermost arcuate fold lines and second arcuate end surface extends substantially at right angles from the other wall toward the one wall with the second arcuate end surface in engagement with the one wall and abutting the arcuate shoulder.

10. The carton forming blank of claim 9 wherein an end wing is hinged to each end edge of the one wall, and an end flap is hinged to each end edge of the other wall.

11. The carton forming blank of claim 10 wherein the front wall has a sight window, and the blank further comprises a transparent sheet overlying the sight window and secured to the front wall.

12. The carton forming blank of claim 11 wherein each end flap has a projecting tongue centrally hinged to its second arcuate end surface.

* * * * *